US008215567B1

(12) United States Patent
Schleuter

(10) Patent No.: US 8,215,567 B1
(45) Date of Patent: Jul. 10, 2012

(54) MODEL RAILROAD ASSEMBLY

(75) Inventor: Wayne Schleuter, Andover, KS (US)

(73) Assignees: Wayne Schlueter, Andover, KS (US); Barbara Schlueter, Andover, KS (US)

( * ) Notice: Subject to any disclaimer, the term of this patent is extended or adjusted under 35 U.S.C. 154(b) by 0 days.

(21) Appl. No.: 13/111,256

(22) Filed: May 19, 2011

(51) Int. Cl.
*E01B 23/00* (2006.01)

(52) U.S. Cl. ..... 238/10 E; 238/10 R; 104/126

(58) Field of Classification Search ..... 238/10 R, 238/10 A, 10 B, 10 E, 10 F, 14.05; 104/53, 104/124, 125, 126
See application file for complete search history.

(56) References Cited

U.S. PATENT DOCUMENTS 2,366,848 A * 1/1945 Ferri ..... 104/295
2,447,273 A * 8/1948 Patrick ..... 246/419
4,948,073 A * 8/1990 Edwards et al. ..... 246/415 A
5,452,893 A * 9/1995 Faulk et al. ..... 463/68
5,752,678 A * 5/1998 Riley ..... 246/415 A
5,979,783 A * 11/1999 Toht et al. ..... 238/10 E
6,123,298 A * 9/2000 Riley ..... 246/415 A
7,354,006 B1 * 4/2008 Bricker ..... 238/10 R
8,061,627 B2 * 11/2011 Norman et al. ..... 238/10 A
8,113,122 B2 * 2/2012 Tarr ..... 104/124
2004/0025738 A1 * 2/2004 Chapman ..... 104/93
2004/0255815 A1 * 12/2004 Tutzauer et al. ..... 104/126

* cited by examiner

*Primary Examiner* — Lars A Olson
*Assistant Examiner* — Jason C Smith
(74) *Attorney, Agent, or Firm* — Kenneth H. Jack; Davis & Jack, L.L.C.

(57) ABSTRACT

A model railroad assembly incorporating a table, an arm having proximal and distal ends, first and second track matrices, the first and second track matrices having electrically positive rails and electrically negative rails, the first track matrix being positioned upon the upper surface of the table, and the second track matrix being positioned upon the arm's upper surface; a hinge connector operatively attaching the arm to the table, the hinge connector facilitating movement of the arm between first and second positions; and a plurality of pivoting electric switch contacts adapted for electrifying the second track matrix upon movement of the arm to the first position, and for de-electrifying the second track matrix upon movement of the arm toward the second position.

15 Claims, 6 Drawing Sheets

MODEL RAILROAD ASSEMBLY

FIELD OF THE INVENTION

This invention relates to model trains and railroads. More particularly, this invention relates to track adaptations of model railroads for facilitation of model railcar and model engine passage, for facilitation of switch clearance, and for facilitation of model railcar and model engine travel direction reversal.

BACKGROUND OF THE INVENTION

Recreational and hobby model train assemblies commonly include a matrix of O, S, HO, or N gauge track which rests upon and is fixedly attached to the upper surface of a display table. The metal rails of such track matrix are typically powered by an induced electrical potential difference wherein one of the rails is electrically positive, and wherein the other of the rail is relatively electrically negative. The rails' electrical potential difference in turn powers a DC electric motor within train's engine, driving the train. Engines and cars traveling upon such track matrix desirably have a capability of passing or exchanging places with other engine and car trains carried upon the matrix, and the model railroad assembly desirably allows trains traveling thereon to reverse directions. Such functions typically require a presence within the track matrix of lengths of track and track switches which are suitable for receiving a first train, and allowing that train to be passed by another train, which are suitable for receiving the first train and facilitating a reversal of direction of travel of that train, or which facilitate clearance of a switch by the train. In many situations, a model railroad's track matrix has insufficient track lengths and/or insufficient track switches to facilitate such functions.

The instant inventive model railroad assembly solves or ameliorates the problems, challenges, and deficiencies discussed above by associating with a table top model railroad track matrix a specialized extension arm in the nature of a yard lead extension. Such arm bears a secondary track matrix having a length suitable for receiving a train engine and cars and allowing them to be passed by another train, or suitable for facilitating a reversal of the direction of travel of the engine and cars, or facilitate switch clearance.

BRIEF SUMMARY OF THE INVENTION

A first structural component of the instant inventive model railroad assembly comprises a table having an upper surface. In a preferred embodiment, the table comprises either a sheet of plywood or a sheet of composite board, such sheet serving as a table top. Under supports are preferably provided for raising the table top to an approximate waist height level for ease of model railroad construction and assembly and for convenience of viewing and operation. Such under supports may suitably comprise pedestal type sawhorse structures or they may comprise a series of legs which are fixedly attached to and extend downwardly from the table top.

A further structural component of the instant inventive model railroad assembly comprises a yard lead extension arm having an upper surface, a proximal end, and a distal end. In a preferred embodiment, such arm comprises a durable aluminum "C" channel beam which includes a web portion and a pair of lateral flanges which extend upwardly from lateral edges of the web. In the preferred embodiment, the floor of the upwardly opening channel of such "C" channel beam serves as an extension of the table surface, and functions similarly with the upper surface of the larger table for track matrix support.

The lateral dimension of the web of the preferred "C" channel beam serves as the effective width of the assembly's arm element, such lateral width preferably being commensurate with the gauge of model railroad track to be laid upon and supported by the arm. For example, where "S" gauge track is to be utilized, the "C" channel web width preferably is between 30-35 millimeters. Where a narrower track, such as HO gauge track, is to be utilized, the web width is used. For HO gauge track, the web width is preferably 20-25 millimeters. Where the web width of the preferred "C" channel configured arm is sized in accordance with the gauge of model railroad track to be supported upon such web, the "C" channel beam's lateral flanges advantageous function as retainer walls which prevent breakage of fragile model train engines and cars which might otherwise fall from the arm.

Further structural components of the instant inventive model railroad assembly comprise first and second track matrices, each track matrix among the first and second track matrices having an electrically positive rail or series of rails, and having an electrically negative rail or rail series. Typically, an AC to DC transformer is provided for converting AC household current to DC current which appropriately powers model railroad engines which may travel upon the first and second track matrices. The direct current output of the transformer is typically connected to the electrically positive and electrically negative rails of the first track matrix, such DC output preferably being rheostat controlled for variable engine speed. In a preferred embodiment, the transformer and rheostat components are housed within a control box mounted at a side edge of the table. In the preferred embodiment, the first track matrix is attached to and positioned upon the upper surface of the table, such matrix suitably comprising a complicated array of track loops, track turns, and track switches. The assembly's second track matrix is preferably positioned upon and supported by the arm's upper surface, the second track matrix preferably comprising a simple straight line railroad track extension.

A further structural component of the instant inventive assembly comprises first mounting means which operatively interconnect the table and the arm. In the preferred embodiment, the first mounting are adapted for facilitating movement of the arm between first and second positions. Upon movement of the arm to the first position, the arm preferably extends substantially horizontally from a side edge of table, the proximal end of the arm being aligned for train rolling communication between the first track matrix and the second track matrix. To facilitate such train rolling communication, rail ends are preferably aligned to closely abut each other so that the small wheels of model railcars and train engines may roll over one rail and onto a next rail. Alternative movement of the arm to the second position necessarily interrupts such train rolling communication.

In a preferred embodiment, the first mounting means comprise a hinge which allows the arm to pivot from a second position orientation which extends downwardly from the table edge to a first position wherein the arm extends horizontally from the table edge. Suitably, the first mounting means may comprise some other commonly known pivoting or releasable fastening assembly such as pin and slot combinations or retainer hooks.

A further structural component of the instant inventive model railroad assembly comprises electrical connecting means which operatively interconnect the table and the arm. In the preferred embodiment, the electrical connecting means are adapted for, at least upon movement of the arm to the first position, respectively electrically connecting the first track matrix's electrically positive and electrically negative rails with the second track matrix's electrically positive and electrically negative rails. Preferably, the electrical connecting means are further adapted for, upon movement of the arm to the second position (preferably extending downwardly in an unobtrusive arm storage position), respectively electrically disconnecting the first matrix's electrically positive and electrically negative rails from the second track matrix's electrically positive and electrically negative rails. In the preferred embodiment, the electrical connecting means comprise a plurality of contact electrodes, a first pair of contact electrodes among such plurality being in electrical communication with the rails of the first track matrix, and a second pair of contact electrodes among said plurality being an electrical communication with the rails of the second track matrix. In the preferred embodiment, the first pair of electrodes comprise spring arm electrical contacts which are mounted upon or are fixed with respect to the table. The second pair of electrodes may correspondingly comprise knife edge or blade electrodes which are mounted for movement with the arm. Such electrode pairs are preferably arranged so that, upon movements of the arm between the first and second positions, the electrode pairs move into and out of contact with each other, advantageously acting as a position actuated "on/off" switch which conducts the first track matrix's electrical power to the second track matrix while the arm extends horizontally from the table, and which alternatively functions as a circuit breaker, cutting off electrical power to the second track matrix upon removal or downward repositioning of the arm toward the second position.

The instant inventive model railroad assembly preferably further comprises a support leg having proximal and distal ends, and second mounting means, the second mounting means being adapted for fixedly attaching the support leg's proximal end to the arm's distal end. In the preferred embodiment, the second mounting means are further adapted for pivotally moving the support leg between third and fourth positions, the support leg's distal end, upon movement of the arm to the first position and upon movement of the leg to the third position, extending downwardly for providing vertical support at the distal end of the arm. Upon retracting pivoting movement of the support leg to the fourth position, the support leg preferably co-extends with and directly underlies the arm for compact and unobtrusive leg storage.

In use of the instant inventive model railroad assembly, an operator may move the arm to the first position, and may thereby cause the assembly's electrical connecting means to extend the provided DC power of the first track matrix to the second track matrix. Where a support leg is provided, the support leg may be pivoted downwardly for vertical support and horizontal positioning of the arm. Thereafter, a first model railroad train may be rollably moved from the first track matrix onto the second track matrix, allowing the position of such first train to allow clear passage for various movements of other model railroad trains upon the first track matrix, or allowing the first model railroad train to reverse its direction of travel, or facilitating switch clearance. Upon termination of model railroad train supporting use of the arm component, the preferably provided support leg may be pivoted to the fourth compact storage position, and the arm may be compactly pivoted downwardly to the second position. Alternatively, the arm's second position may comprise one in which the arm is wholly removed and is separately stored. Regardless of which arm storing second position is utilized, the electrical connecting means are preferably adapted to terminate the supply of electrical power upon movement of the arm toward the second position.

Accordingly, objects of the instant inventive include a provision of a model railroad assembly which incorporates structures, as described above, and which arranges those structures in relation to each other in manners described above for the achievement of the functions, benefits, and advantages described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
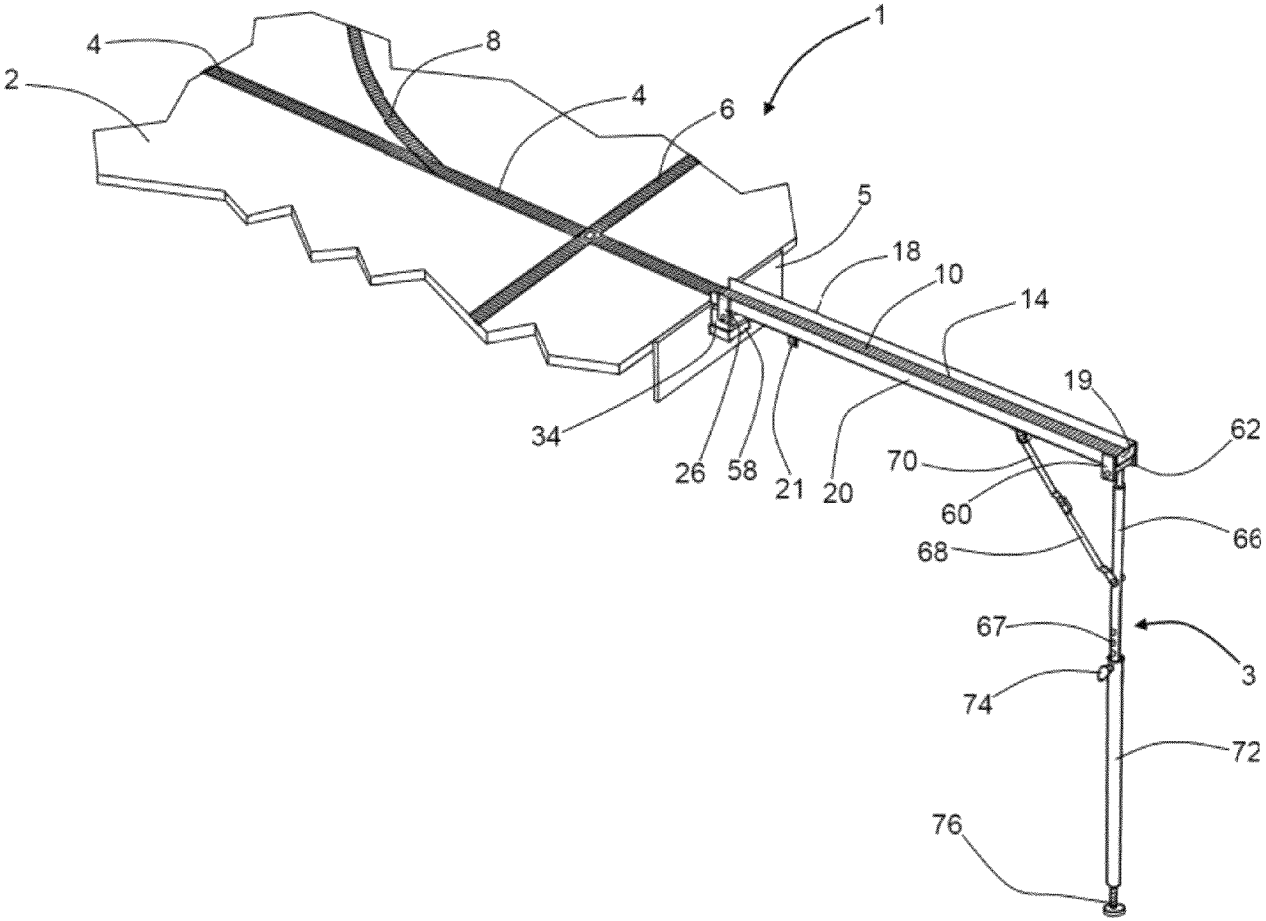
FIG. 1 is a perspective view of a preferred embodiment of the instant inventive model railroad assembly.
Figure 5:
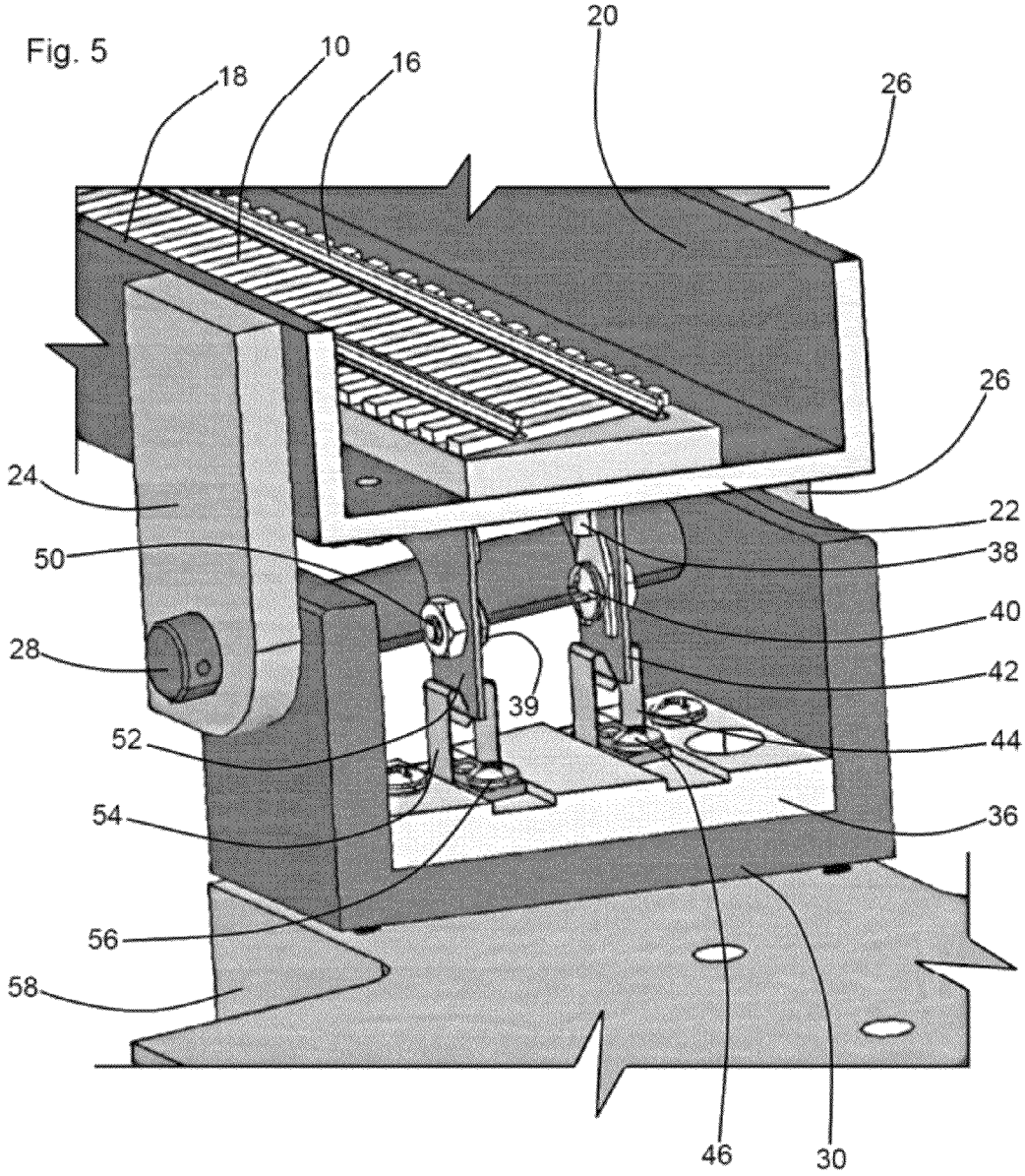
FIG. 5 redepicts FIG. 4, the view of FIG. 5 showing the arm component pivoted upwardly to a first position.

Referring now to the drawings, and in particular to FIGS. 1 and 5, a preferred embodiment of the instant inventive model railroad assembly is referred to generally by Reference Arrow 1. The assembly 1 preferably comprises a table 2 and an arm 18,20,22 which is configured as an upwardly opening "C" channel beam. In the preferred embodiment, the web portion 22 of the "C" channel beam serves as an extension of table 2, while such beam's lateral flanges 18 and 20 advantageously function as side rails for prevention of falling of model railroad engines and cars. A barrier or end wall 19 preferably spans laterally between the distal ends of flanges 18 and 20 to prevent trains from rolling distally off of the arm 18,20,22.

Referring to FIG. 1, the assembly 1 preferably further comprises a first track matrix 4,6,8 which is fixedly attached to the upper surface of table 2. Referring further to FIG. 5, a second track matrix 10 is similarly fixedly attached to and is support upon the web portion 22 of the "C" channel configured arm 18,20,22. Such second track matrix 10 is preferably a simple straight line extension and has electrically positive and electrically negative rails 14 and 16. The first track matrix 4,6,8 preferably similarly has electrically positive and electrically negative rails whose electrical power may, through electrical contacts further discussed below, be extended to the second matrix's rails.

Figure 4:
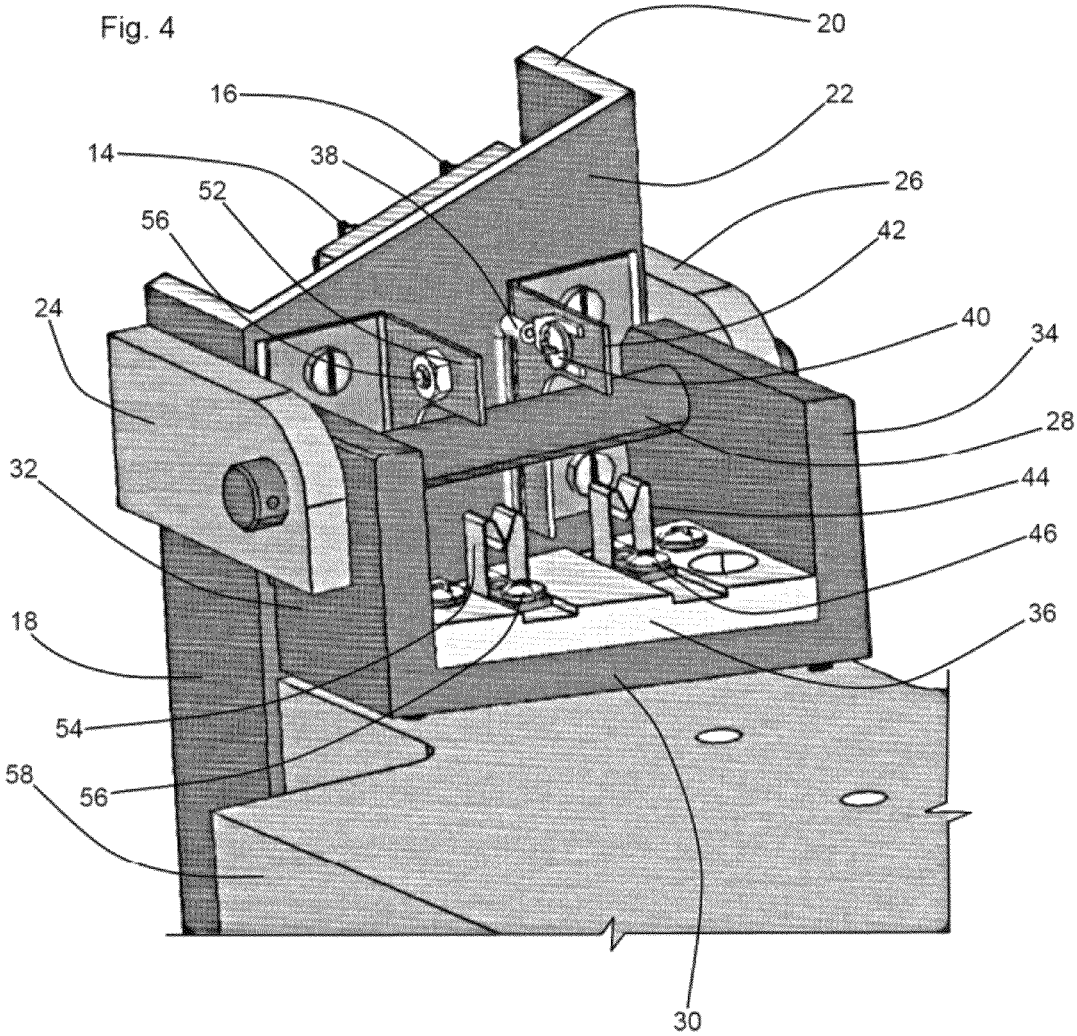
FIG. 4 is an alternative partial view of the structure of FIG. 1, the view of FIG. 4 showing an arm component pivoted downwardly to a second position.
Figure 5A:
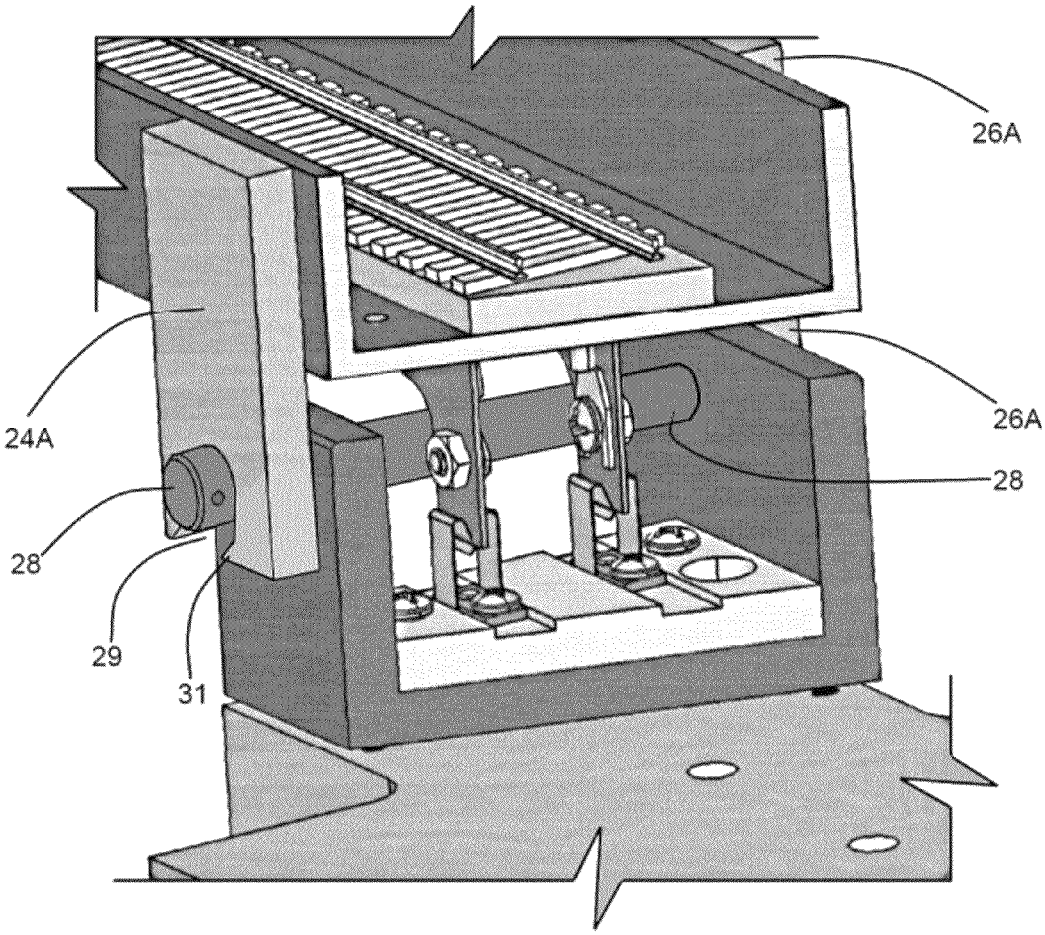
FIG. 5A presents an alternative configuration of the structure depicted in FIG. 5.

Referring to FIGS. 1 and 4, first mounting means are provided for operatively connecting the arm 18,20,22 to the table 2, such means preferably comprising hinge and mounting structures including a table mounting block 58 which is fixedly attached to the undersurface of the table 2, a pin supporting "C" block 30,32,34, a hinge pin 28 which is supported by the "C" block, and a pair of hinge pin receiving ears 24 and 26 whose upper ends are preferably rigidly attached to laterally opposite sides of the proximal end of arm 18,20,22. Such hinge adapted mounting means assembly advantageously allows the arm 18,20,22 to pivotally move from the horizontally extending first position or use position which is depicted in FIG. 5, to a downwardly extending second position or storage position which is depicted in FIG. 4. Alternatively, referring further simultaneously to FIG. 5A, the hinge pin receiving ears 24 and 26 of FIG. 4 may be re-configured according to the "U" slot structure of ears 24A and 26A of FIG. 5A. In such alternative structure, ears 24A and 26A present downwardly opening slots 29 which receive the laterally opposite ends of pin 28. In the alternative configuration of FIG. 5A, the arm component may compactly hang downwardly at the second storage position in a manner similar to the FIG. 4 configuration. In such position, hook tabs 31 prevent pin 28 from slidably falling out of slots 29, and prevent the arm component from falling to the floor. Alternatively, an operator may completely remove the arm 18,20,22 by imposing an upward and slightly forward movement, resulting in disengagement and extraction of pins 28 from slots 29. Upon such arm disengagement and removal, the assembly's second position may suitably constitute a storage of the arm 18,20,22 at a remote location.

Referring simultaneously to FIGS. 1, 4, and 5, the instant inventive model railroad assembly preferably further comprises electrical connecting means which operatively interconnect the first track matrix of table 2 with second track matrix of arm 18,20,22. In the preferred embodiment, the electrical connecting means comprise a plurality of contact electrodes 42,52,44, and 54, electrode pair 42 and 52 being configured as knife electrodes, and electrode pair 44 and 54 being configured as spring arm or spring contact electrodes. Upon movement of the arm 18,20,22 from the second position depicted in FIG. 4 to the first position depicted in FIG. 5, knife electrodes 42 and 52 move orbitally about hinge pin 28 until distal ends of such electrodes 42 and 52 come into sliding contact with the spring arm electrodes 44 and 54. Electrical communication between rail 16 and knife electrode 42 is preferably provided via a wire lead (not depicted within views) which extends from rail 16 to a screw engaging "U" connector 38, such connector being held by screw 40. Rail 14 is similarly mounted via a wire lead, a "U" connector 39, and screw 50 combination. Similar wire leads preferably extend from the electrically positive and electrically negative rails of the first track matrix 4,6,8, such wire leads extending through an electrically insulating block 36, and being held by wire lead clamping screws 46 and 56.

Figure 3:
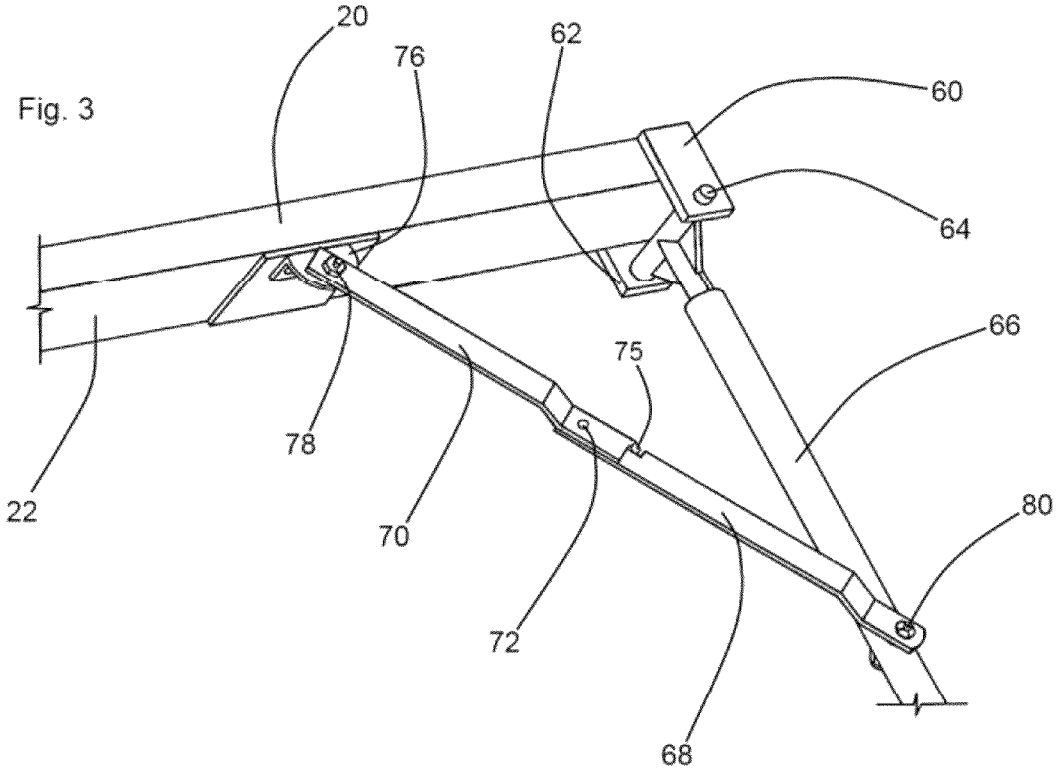
FIG. 3 is a partial alternate perspective view of the structure of FIG. 1.

Referring simultaneously to FIGS. 1 and 3, the instant inventive model railroad assembly preferably further comprises a leg which is referred to generally by Reference Arrow 3, such leg having an upper proximal end and a lower distal end. Associated with the leg 3, the assembly preferably further comprises second mounting means which are adapted for fixedly attaching the leg's proximal end to the distal end of the arm 18,20,22. The second mounting means are preferably further adapted for facilitating pivoting movement of the leg 3 between third and fourth positions, the leg 3 extending downwardly in the position depicted in FIG. 1 upon movement to the third position, and the leg 3 co-extending with and underlying the arm 18,20,22 upon pivoting movement to the fourth position. In the preferred embodiment, such pivoting second mounting means comprise hinge ears 60 and 62 which rotatably receive the laterally opposite ends of a hinge pin 64. The upper end of leg 3 and hinge pin 64 preferably form a pivoting "T" joint.

Referring further simultaneously to FIGS. 1 and 3, the depicted configuration of the leg 3 incorporates height adjusting telescoping means which preferably takes the form of a distal quill 72 and a proximal shaft 66 assembly. A series of height adjustment eyes 67 preferably extend laterally through the shaft 66, such eyes 67 selectively receiving a lock pin 74 which may extend laterally through alignable eyes which open at the upper end of the quill segment 72. In use, an operator may remove pin 74, and the operator may slidably vertically position quill segment 72 with respect to shaft segment 67. Upon aligning of overlying and underlying eyes at a selected leg length position which supports the arm 18,20,22 in a horizontal orientation with respect to table 2, pin 74 may be re-inserted by the operator.

Referring further simultaneously to FIGS. 1 and 3, the leg 3 preferably further incorporates releasable locking means which span in the manner of a triangulating brace between the arm 18,20,22 and the leg 3. The releasable locking means are preferably adapted for, upon movement of the leg 3 to the third position, resisting any retracting or extending movement of the leg 3 away from the third position. In the preferred embodiment, the releasable locking means comprise a pivoting elbow brace 68,70, and 72, such brace having a pivot stop 75. The upper end of brace 68,70,72 is preferably pivotably mounted upon the arm 18,20,22 by an ear and bolt combination 76 and 78, and the lower end of such brace is similarly pivotally mounted by bolt 80 upon the shaft segment of the leg 3. Upon counter-clockwise and clockwise rotations of elbow brace segments 70 and 68 about bolts 78 and 80, the leg 3 may be retracted to its fourth compact storage position, the leg 3 co-extending with and underly the arm 18,20,22 at such position. Upon complete retraction of leg 3 to the fourth position underlying arm 18,20,22, a downwardly opening "C" clip 21 may releasably capture the leg's quill segment 72, holding the leg 3 at the compact storage fourth position. Opposite clockwise and counter-clockwise rotations of elbow brace segments 70 and 68 may continue until stop tab 75 meets elbow brace segment 68. Upon such rotations, the leg 3 is advantageously held in its downwardly extended third position.

Referring further simultaneously to FIGS. 1 and 3, the inventive assembly preferably further comprises a screw actuated height adjusting foot 76 which engages a helically threaded downwardly opening socket at the distal end of leg 3. Turning and counter-turning of the foot 76 may advantageously "fine tune" the height of the distal end of arm 18,20,22, assuring that such arm occupies substantially the same horizontal plane as the table 2.

Figure 2:
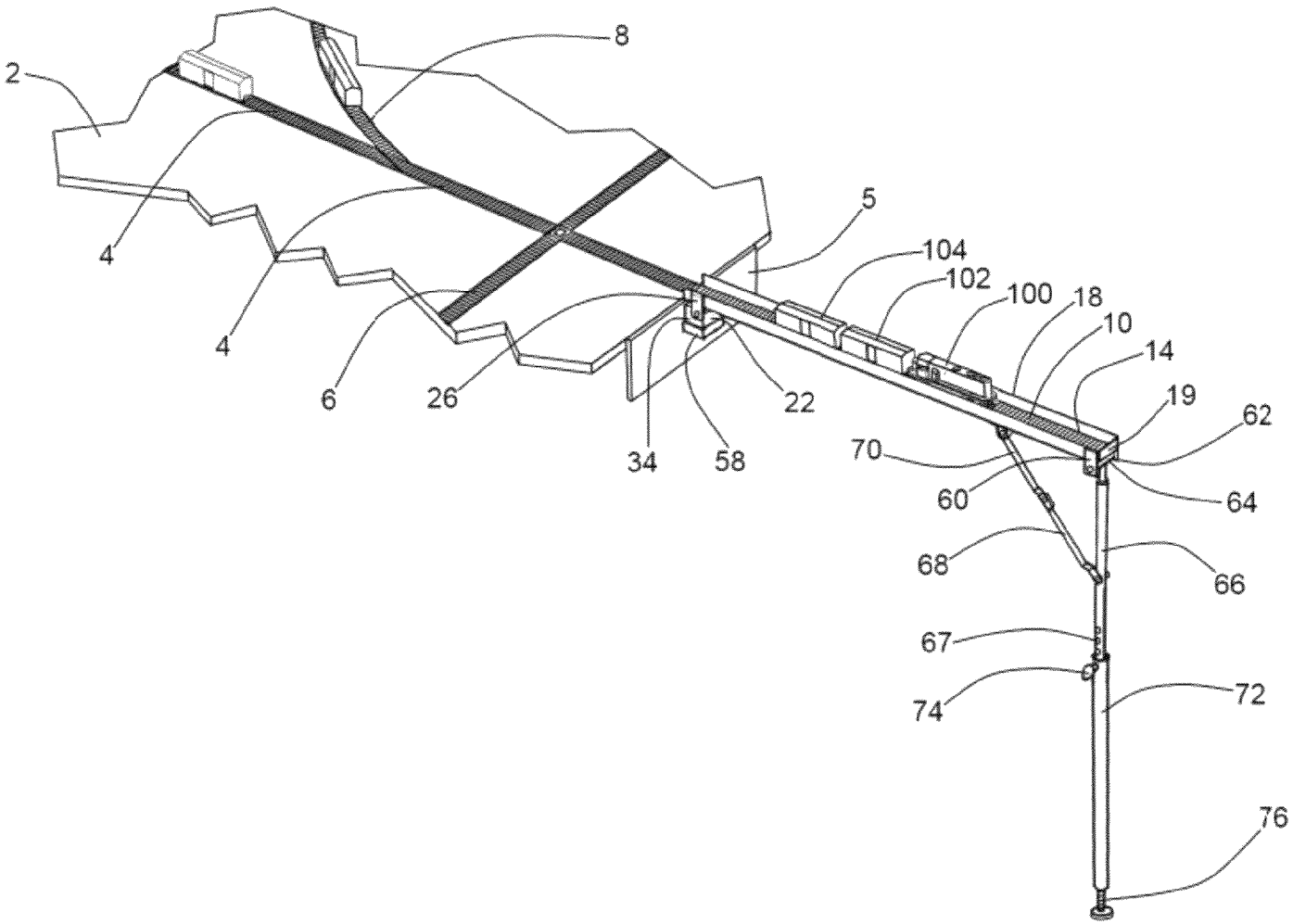
FIG. 2 redepicts FIG. 1, the view of FIG. 2 showing railcars and a model railroad engine carried upon the assembly.

In use of the instant inventive model railroad assembly, referring simultaneously to FIGS. 1-5, the arm 18,20,22 may be initially configured as depicted in FIG. 1. As a result of such configuration, knife electrode contacts 42 and 52 electrically contact spring arm contacts 44 and 54 and cause the electrical potential difference between the rails of the first track matrix 4,6,8 to electrically power the second track matrix 10. Accordingly, a model train engine 100 may move under electrical power from track matrix 4,6,8 onto track matrix 10, and may draw train cars 102 and 104 therewith. Upon parked positioning of the engine 100 and cars 102 and 104 upon the arm 18,20,22 as depicted in FIG. 2, clearance is provided for passage and movement of other model railroad engines and cars upon the track matrix 2,6,8. Such positioning of engine 100 and cars 102 and 104 may also facilitate switch clearance. Following such usage, leg 3 may be foldably retracted to its fourth position, and the arm 18,20,22 may be pivotally moved to its downwardly extending second position. Alternatively, referring further simultaneously to FIG. 5A, the arm 18,20,22 may be placed at a completely removed second position through a disengaging extraction of pin 28 from the alternative configuration "U" slots 29.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A model railroad assembly comprising:

(a) a table having an upper surface;

(b) an arm cantilevering with respect to the table's upper surface, the arm having an upper surface, a proximal end, and a distal end;

(c) first and second track matrices, each track matrix among the first and second track matrices having an electrically positive rail and having an electrically negative rail, the first track matrix being positioned upon the upper surface of the table, and the second track matrix being positioned upon the arm's upper surface;

(d) first mounting means operatively interconnecting the table and the arm, the first mounting means facilitating movement of the arm between first and second positions, the first and second track matrices being in train rolling communication with each other upon movement of the arm to the first position, the train rolling communication being interrupted upon movement of the arm to the second position; and (e) electrical connecting means operatively interconnecting the table and the arm, the electrical connecting means being adapted for at least upon movement of the arm to the first position, respectively electrically connecting the first track matrix's electrically positive and electrically negative rails with the second track matrix's electrically positive and electrically negative rails.

2. The model railroad assembly of claim 1 wherein the electrical connecting means are further adapted for, upon movement of the arm to the second position, respectively electrically disconnecting the first track matrix's electrically positive and electrically negative rails from the second track matrix's electrically positive and electrically negative rails.

3. The model railroad assembly of claim 2 wherein the first mounting means comprise a first hinge.

4. The model railroad assembly of claim 3 wherein the table has an edge and wherein, upon the movement of the arm to the second position, the arm's distal end extends downwardly from the edge.

5. The model railroad assembly of claim 4 wherein the electrical connecting means comprise a plurality of contact electrodes.

6. The model railroad assembly of claim 5 wherein the contact electrode plurality comprises a pair of knife electrodes and a pair of spring arm electrodes.

7. The model railroad assembly of claim 6 wherein the arm and the second track matrix are substantially straight.

8. The model railroad assembly of claim 1 further comprising a leg having proximal and distal ends, and second mounting means, the second mounting means being adapted for fixedly attaching the leg's proximal end to the arm's distal end.

9. The model railroad assembly of claim 8 wherein the second mounting means are further adapted for pivotally moving the leg between third and fourth positions, the leg's distal end, upon movement of the arm to the first position and upon movement of the leg to the third position, extending downwardly.

10. The model railroad assembly of claim 9 wherein the leg, upon movement to the fourth position, co-extends with the arm.

11. The model railroad assembly of claim 10 wherein the leg comprises a proximal segment, a distal segment, and telescoping means operatively interconnecting the proximal and distal segments.

12. The model railroad assembly of claim 11 wherein the telescoping means comprise a quill and shaft assembly.

13. The model railroad assembly of claim 12 further comprising releasable locking means connected operatively to the arm and to the leg, the releasable locking means being adapted for, upon movement of the leg to the third position, resisting movement of the leg away from the third position.

14. The model railroad assembly of claim 13 wherein the releasable locking means comprise a pivoting elbow brace.

15. The model railroad assembly of claim 14 further comprising a screw actuated height adjustment foot connected operatively to the leg's distal end.

* * * * *